US006762547B2

(12) United States Patent
Arai et al.

(10) Patent No.: US 6,762,547 B2
(45) Date of Patent: Jul. 13, 2004

(54) IMAGE DISPLAY DEVICE

(75) Inventors: Yutaka Arai, Kanagawa (JP); Mitsutoshi Hasegawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/237,882

(22) Filed: Sep. 10, 2002

(65) Prior Publication Data

US 2003/0058192 A1 Mar. 27, 2003

(30) Foreign Application Priority Data

Sep. 14, 2001 (JP) ..... 2001/279604

(51) Int. Cl.[7] ..... H01J 29/94; H01J 31/12

(52) U.S. Cl. ..... 313/481; 313/552; 313/553; 313/554; 313/555; 313/558

(58) Field of Search ..... 313/481, 552, 313/553, 554, 555, 558, 559, 561; 417/48, 51

(56) References Cited

U.S. PATENT DOCUMENTS 6,060,113 A 5/2000 Banno et al. ..... 427/78
6,184,610 B1 2/2001 Shibata et al. ..... 313/309
6,210,245 B1 4/2001 Sando et al. ..... 445/6
6,220,912 B1 4/2001 Shigeoka et al. ..... 445/24
6,309,691 B1 10/2001 Hasegawa ..... 427/8

FOREIGN PATENT DOCUMENTS

JP 2000-200571 * 7/2000 ..... H01J/29/94

* cited by examiner

*Primary Examiner*—Ashok Patel
*Assistant Examiner*—Sharlene Leurig
(74) *Attorney, Agent, or Firm*—Fitzpatrick, Cella, Harper & Scinto

(57) ABSTRACT

An image display device of the present invention includes a container having a substrate; an electron source provided thereon; and an image display member which opposes the electron source substrate and which displays an image when being irradiated with electrons emitted from the electron source. In addition, the container further has first getters provided in an image display area which is formed between the image display member and the electron source, and ring non-evaporable second getters which are provided outside the image display area.

4 Claims, 6 Drawing Sheets

IMAGE DISPLAY DEVICE

BACKGROUND OF THE INVENTION

1. Field of the Invention

The present invention relates to image display devices comprising getters.

2. Description of the Related Art

In image display devices each of which displays images by irradiating a fluorescent material, which functions as an image display member, with electron beams emitted from an electron source so that the fluorescent material emits light, the inside of a vacuum container containing the electron source and the image display member must be placed in a highly evacuated state. In general, the vacuum container of an image display device is formed of glass members bonded together with frit glass or the like which is provided at the bonding portions therebetween, and after the bonding is performed, a pressure inside the vacuum container is maintained by getters which are placed therein.

A getter is a common name of a material which is placed inside a chamber so as to maintain an evacuated state after the chamber being evacuated by a pump or the like. The getter is roughly categorized into an evaporable getter and a non-evaporable getter. The evaporable getter literally forms a metal thin-film on an opposing surface by evaporating a material using high-frequency induction heating, electric heating, or the like so as to suppress the movement of residual gases by chemical reaction (adsorption) thereof with the metal film in an evacuated state, thereby maintaining an evacuated state. In contrast, in the non-evaporable getter mentioned above, a new metal is come out on the getter surface since a metal oxide, carbide, nitride, or the like covering the getter diffuses thereinto by supplying energy thereto by electric heating means or the like, and hence the new metal thus come out becomes able to react with residual gases in an evacuated state, thereby maintaining an evacuated state. In general, a step of exposing a new metal surface is called an activation step, and by this activation step, a getter becomes able to function to maintain an evacuated state. The capabilities of the evaporable and non-evaporable getters for maintaining an evacuated state by reaction with residual gases present in a vacuum are approximately equivalent to each other, and as for the evaporable getter, it is preferable that the distance between the getter and the opposing surface be relatively large in order to form a large surface area of the metal film. In contrast, as for the non-evaporable getter, there has been no distance limitation at all. In addition, as for the non-evaporable getter, when an activation step is again performed after adsorption capability of the getter is fully used, a new metal surface can again be obtained on the surface of the getter since a metal oxide, carbide, nitride, or the like formed on the surface again diffuses into the getter, and hence the getter can be repeatedly used as long as this activation step can be effectively performed. Whether the activation step is effectively performed or not depends on an atmosphere in which the getter is used, and the activation step is preferably preformed in a more highly evacuated state.

In general cathode-ray tubes (CRTs), as the getter described above, an evaporable getter alloy primarily composed of barium (Ba) has been used. A deposition film is formed on inside walls of a CRT, which is sealed beforehand by bonding, by heating an evaporable getter using electricity or high frequency so as to adsorb gases generated inside the CRT, thereby maintaining a highly evacuated state. In CRTs, due to the unique shape thereof, a wall-surface area inside CRT, on which an electron source or an image display member is not provided, is sufficiently present, and on the area described above, a deposition film may be formed by evaporating an evaporable getter.

In addition, in recent years, development of flat display devices has been aggressively performed in which a number of electron emitters functioning as an electron source are disposed on a flat substrate, and electrons generated from the electron source in a vacuum container formed of the electron source and image display member are accelerated by anodes so as to collide against the image display member for displaying images. In the flat display device, a volume of the vacuum container is small compared to that of a CRT; however, a wall-surface area which emits gases is not decreased. Accordingly, when gases are generated having a volume approximately equivalent to that of gases generated in a CRT, a pressure inside the vacuum container is largely increased, and hence the electron source is seriously influenced thereby. In addition, in the case of a flat display device, a large area of the inside walls of the vacuum container is occupied by the electron source and the image display member. Accordingly, when a getter film made from the evaporable getter described above is formed on the area described above, since adverse influences such as short-circuiting of wires may occur, areas in which the getter film is formed are limited to places at which the electron source and the image display member are not provided. For example, it may be considered that a getter film is formed on edge portions inside the vacuum container and is not formed in an area (hereinafter referred to as "image display area") which is located between the image display member and the electron source. However, when the size of the flat display device is increased to some extent, it becomes difficult to secure a surface area of the getter film compared to a gas volume which will be generated.

In addition, in the flat display device, a problem in that a pressure is locally increased in the vacuum container may occur in some cases. Parts of the vacuum container at which gases are generated are primarily the image display member irradiated with electron beams and the electron source. In the flat display device, since the image display member and the electron source are close to each other, gases generated from the image display member reach the electron source before being sufficiently diffused, and hence local increase in pressure occurs in the vacuum container. In particular, gases generated at the central portion of the image display area are difficult to diffuse to an area at which the getter film is formed, and hence it has been considered that local increase in pressure frequently occurs at the central portion of the image display area as compared to that at the peripheral portion thereof.

Accordingly, in the flat display device, in addition to the peripheral portion of the image display area, the structure in which a getter material is provided in the image display area so as to adsorb a gas immediately has been considered.

However, when the size of a non-evaporable getter disposed at the periphery of the image display area is increased to some extent, the distance between the getter and an anode plate used for image display is decreased, and as a result, discharge therebetween may occur by a high voltage applied during display operation in some cases. When the discharge occurs, a high voltage at which the discharge occurs cannot be applied, and hence a brighter image cannot be displayed.

In addition, by thermal expansion of the non-evaporable getter which occurs during activation thereof, the getter may be unexpectedly brought into contact with members forming the flat display device, and in some cases, the display itself may be damaged. In order to prevent the problem described above, placement of the getters and constituent members must be performed with high accuracy, and as a result, the yield may be decreased in some cases.

In addition, when a non-evaporable getter is activated by electric heating, terminals for supplying electricity must extend outside the vacuum container, and as a result, a vacuum leak which occurs at the terminals may decrease the yield in some cases.

Furthermore, depending on image quality to be displayed, a vacuum container constituting the display device must be designed so that the height has upper and lower values. Depending on the values of height design, a non-evaporable getter having a conventional volume may not be provided in the vacuum container in some cases. In addition, when a core member of non-evaporable getter is too small, a technical problem in that material of getter cannot be fixed thereto may also occur in some cases.

SUMMARY OF THE INVENTION

An object of the present invention is to provide a image display device capable of maintaining image quality while increase in pressure in a vacuum container is prevented and suppressing discharges with an anode plate while display is performed.

In addition, another object of the present invention is to provide an image display device which can be manufactured with a high yield by avoiding damage done to non-evaporable getters provided at the periphery of the image display area and vacuum leaks, which occur during activation.

The present invention relates to an image display device having a container which includes an electron source substrate, an electron source provided thereon, and an image display member which opposes the electron source substrate and which displays an image when being irradiated with electrons emitted form the electron source. The container described above further comprises first getters provided in an image display area which is located between the electron source and the image display member, and ring non-evaporable second getters provided outside the image display area.

Further objects, features and advantages of the present invention will become apparent from the following description of the preferred embodiments with reference to the attached drawings.

DESCRIPTION OF THE PREFERRED EMBODIMENTS

Figure 1:
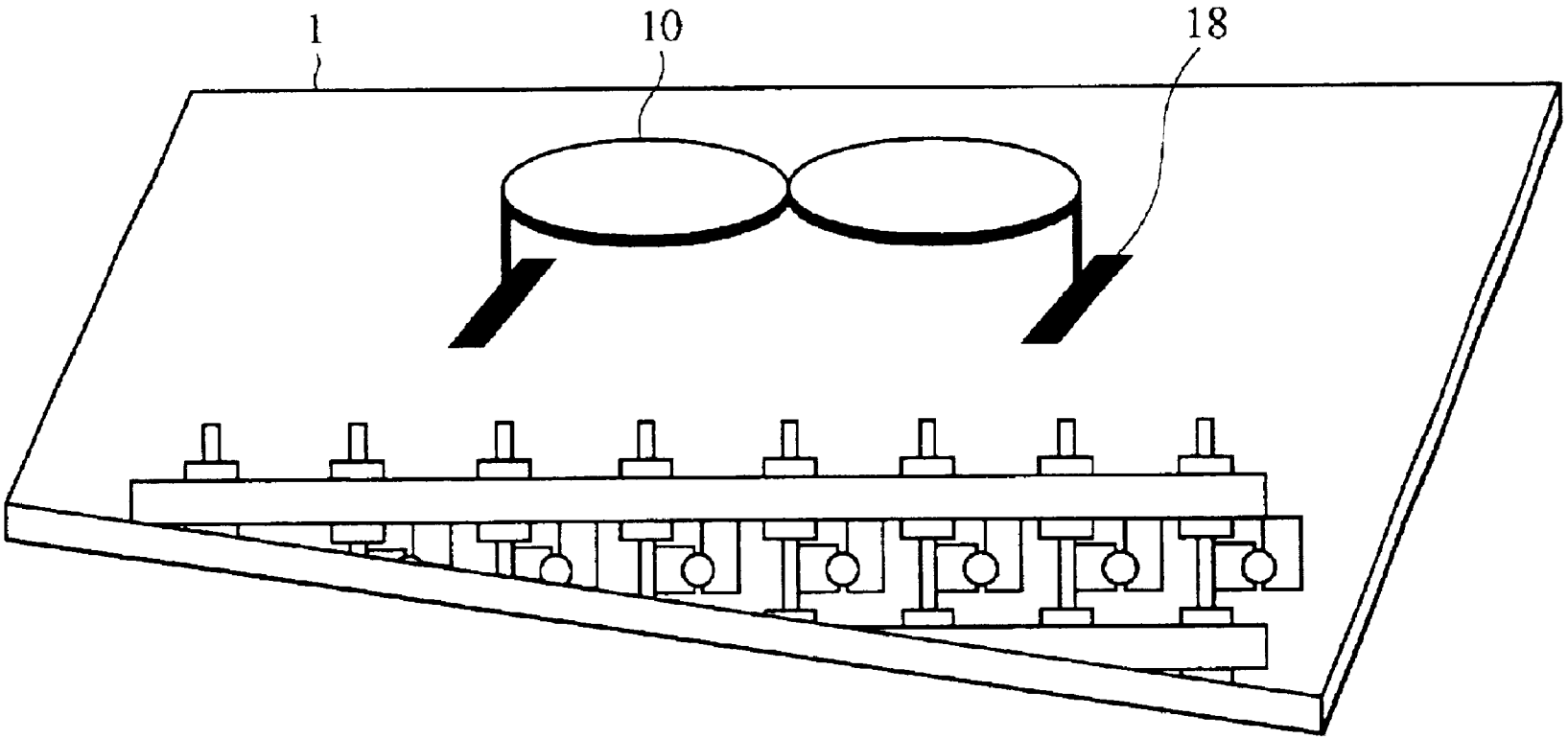
FIG. 1 is a schematic view for illustrating the structure of second getters according to the present invention and a disposing method thereof.

The present invention relates to an image display device having a container which comprises an electron source substrate, an electron source provided thereon, and an image display member which opposes the electron source substrate and which displays an image when being irradiated with electrons emitted from the electron source. The container described above further comprises first getters provided in an image display area, which is located between the electron source and the image display member, and ring non-evaporable second getters which are provided outside the image display area.

In addition, according to the present invention described above, it is preferable that the second getters be provided so as to surround the first getters and/or that the first getters be non-evaporable getters. Furthermore, it is also preferable that the electron source comprise a plurality of electron emitters and wires for said plurality of electron emitters, and that the first getters be disposed on the wires described above.

Each of the ring non-evaporable getters described above preferably has the structure in which a non-evaporable getter material is tightly bonded to a core material formed of a metal or an alloy, and in addition, the core material preferably has a melting point equivalent to or higher than that for activating the non-evaporable getter described above.

The second getters described above are preferably ring non-evaporable getters which can be activated from the outside of the container by high-frequency induction heating.

In addition, the second getters described above are preferably activated from the outside of the container by high-frequency induction heating after the container of the image display device being formed.

In the present invention, the image display area means an area located between the electron source and the image display member opposing thereto.

It is preferable that the image display member of the present invention be formed of a fluorescent film and a metal back and be disposed on an interior surface of a plate opposing the electron source substrate; however, both the fluorescent film and the metal back are not disposed on the entire interior surface of the plate. Accordingly, the outside of the image display area is an area located between the surface of the electron source substrate and the surface of the plate on which the fluorescent film or the meal back is not provided.

According to the image display device of the present invention, since the getters disposed in the image display area and the ring non-evaporable getters disposed outside the image display area are both used, gases generated from the electron source and gases generated by bombarding the image display member with electron beams can be adsorbed and simultaneously evacuated. In particular, concerning the adsorption of gases generated from materials present outside the image display area, the getters disposed outside the image display area adsorb and evacuate the gases described above faster than the getters disposed in the image display area. Accordingly, increase in pressure, which locally occurs, can be prevented, and discharges during operation and vacuum leaks and damages during manufacturing can also be prevented.

Hereinafter, preferred embodiments of the present invention will be described with reference to figures.

FIG. 1 is a schematic view showing a ring 10 comprising a non-evaporable getter material and provided on an electron source substrate 1 outside the image display area.

The ring 10 comprising the non-evaporable getter material is composed of a nichrome wire 200 μm in external diameter functioning as the core wire and a non-evaporable getter material approximately 5 μm thick fixed thereon. When being not directly fixed on the substrate, the ring 10 may be fixed on the electron source substrate 1 with a fixing member 18 formed of Dumet, alloy 426, or the like. The height including the fixing member 18 is approximately 1 mm.

Figure 2A:
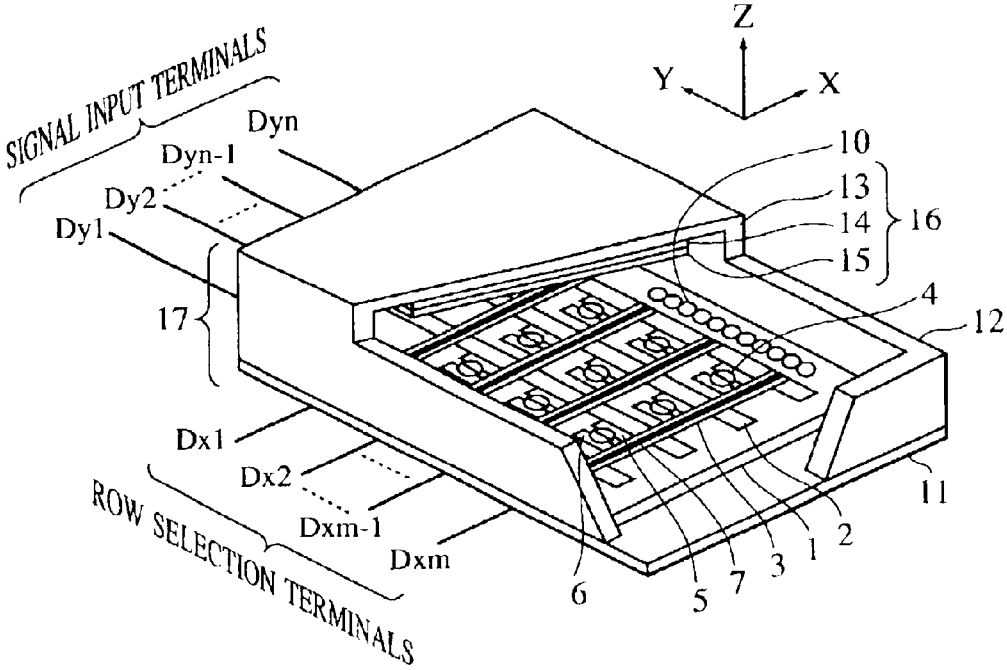
FIG. 2A is a perspective view showing the structure of an image display device according to the present invention.
Figure 2B:
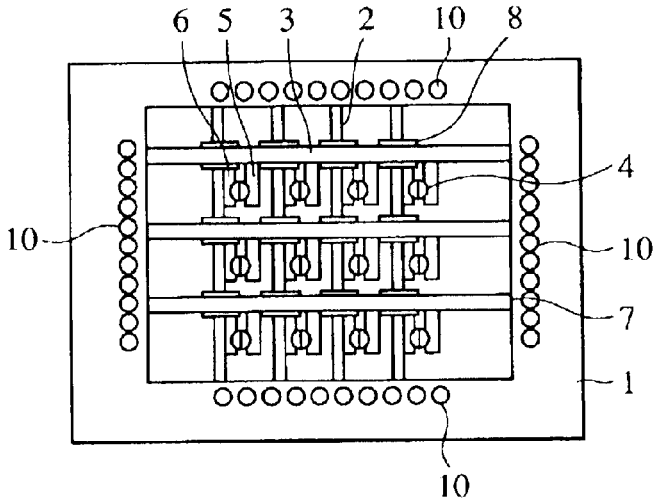
FIG. 2B is a plan view showing an electron source substrate of the image display device shown in FIG. 2A.

Hereinafter, this embodiment will be described with reference to FIGS. 2A and 2B. FIG. 2A is a schematic, perspective view showing an example of the structure of an image display device according to the present invention. Reference numeral 1 indicates the electron source substrate, and a plurality of electron emitters and wires described below are provided on the electron source substrate 1. Reference numeral 3 indicates X-directional wires (upper wires), and reference numeral 2 indicates Y-directional wires (lower wires). Reference numeral 4 indicates conductive films having electron emission portions formed thereon, and the conductive films are each provided between electrodes 5 and 6 and connected thereto. The electron emitter formed of the constituent elements 4, 5, and 6 described above is referred to as a surface conductive electron emitter. In addition, reference numeral 7 indicates a non-evaporable getter (first getter) which is disposed on the upper wire 3 and is located in the image display area. Reference numeral 10 indicates a ring composed of a nichrome wire 200 μm in external diameter functioning as the core wire and a Zr—V-based alloy fixed thereon which functions as a non-evaporable getter material. The ring described above is fixed on the electron source substrate 1 by a fixing member (not shown) composed of alloy 426 and can be heated from the outside of a vacuum container by high-frequency induction heating. As shown in FIG. 2B, which is a plan view of the electron source substrate 1 of the image display device shown in FIG. 2A, a plurality of the ring non-evaporable getters 10 (second getters) is disposed along each of four sides surrounding the first getters 7 provided on the electron source substrate 1, and although not shown in the figure, a fluorescent film 14 and a metal back 15, both of which constitute an image display member described later, are not provided over the second getters 10.

In addition, reference numeral 16 indicates a face plate composed of a glass substrate 13, the fluorescent film 14, and the metal back 15 laminated in that order from the bottom. The face plate 16 is bonded to the electron source substrate 1 with a supporting frame 12 provided therebetween using frit glass for sealing, thereby forming a container 17. In order to maintain an evacuated state inside the container 17, a reinforcing plate 11 may be provided for the electron source substrate 1 in some cases so as to withstand an atmospheric pressure.

The electron source substrate 1 will be described in detail with reference to FIG. 2B. The same reference numerals of the elements in FIG. 2A designate the same elements in FIG. 2B, and as shown in FIG. 2B, interlayer insulating layers 8 are each provided between the X-directional wire 3 and the Y-directional wire 2 for insulating the wires described above from each other.

Various arrangements of the electron emitters may be used, and in this embodiment, a simple matrix arrangement is used by way of example. The simple matrix arrangement is an arrangement in which pluralities of lines formed of the electron emitters are disposed in the X-direction and in the Y-direction, first electrodes of the electron emitters disposed in the same row are commonly connected to a corresponding X-directional wire, and second electrodes of the electron emitters disposed in the same column are commonly connected to a corresponding Y-directional wire.

As shown in FIG. 2A, there are m pieces of X-directional wires, that is, Dx1, Dx2, . . . , and Dxm, and these wires may be formed by a vacuum deposition method, a printing method, a sputtering method, or the like using a conductive metal or the like. A material, a film thickness, and a width of the wire may be optionally designed. There are n pieces of Y-directional wires, that is, Dy1, Dy2, . . . , and Dyn, and the wires may be formed in a manner similar to that for the X-directional wires. Between the these m pieces of the X-directional wires and n pieces of the Y-directional wires, the interlayer insulating layers 8 are provided as shown in FIG. 2B, so that the X-directional wires and the Y-directional wires are electrically separated from each other (both m and n are positive integers).

The interlayer insulating layer 8 of $SiO_2$ or the like is formed by a deposition method, a printing method, a sputtering method, or the like. For example, the interlayer insulating layers in a desired shape are formed over the entire surface or on part of the electron source substrate 1 provided with the X-directional wires. In particular, in order to withstand a potential difference at the intersection between the X-directional wire and the Y-directional wire, a thickness, a material, and a manufacturing method of the interlayer insulating layer are optionally determined. The X-directional wires and the Y-directional wires extend to the outside so as to function as external terminals.

The electrodes 5 and 6 forming the electron emitters are electrically connected to each other by m pieces of the X-directional wires, n pieces of the Y-directional wires, and connection wires made of conductive metal or the like.

Some or all of elements of the material forming the wires 2 and 3 may be the same as those of materials forming the connection wires, and the pair of electrodes, or the elements thereof may be different from each other. The materials described above may be optionally selected from, for example, the materials for forming the electrodes.

Means (not shown in the figure) for applying scanning signals for selecting a row of the electron emitters disposed in the X-direction is connected to the X-directional wires. In addition, to the Y-directional wires, means (not shown in the figure) for generating modulation signals for modulating in accordance with input signals each column of the electron emitters disposed in the Y-direction is connected. A driving voltage applied to each of the electron emitters is the difference in voltage between the scanning signal and the modulation signal applied to the corresponding element.

When the surface conductive electron emitter of this embodiment is used as the electron emitter, according to the characteristics thereof, electron emission of the emitter above the threshold voltage thereof can be controlled by a wave height and a wave width of a pulse voltage applied between the electrodes opposing each other. On the other hand, below the threshold voltage, substantially no electrons are emitted. According to the characteristics described above, even in the case in which a plurality of electron emitters is provided, when a pulse voltage is appropriately applied to each emitter, the surface conductive electron emitter can be selected in accordance with an input signal, and hence an amount of electron emission can be controlled.

On the X-directional wires 3 in the image display area, non-evaporable getters 7 are disposed. As the non-evaporable getter 7, a commercially available Zr-based alloy can be used, and in addition to a known vacuum deposition method such as sputtering, a plasma spraying method can also be used for forming the non-evaporable getter 7.

In the structure described above, by using simple matrix wiring, the emitters are individually selected, and hence each emitter can be driven independently.

The face plate 16 of an image display device formed of the electron source in the simple matrix arrangement described above will be described with reference to FIGS. 2A, 3A, and 3B.

As shown in FIG. 2A, the container 17 is formed of the face plate 16, the supporting frame 12, and the reinforcing plate 11. Between the face plate 16 and the reinforcing plate 11, when a supporting body (not shown in the figure) called a spacer is provided, the container 17 can be formed having a sufficient strength which can withstand an atmospheric pressure.

Figure 3A:
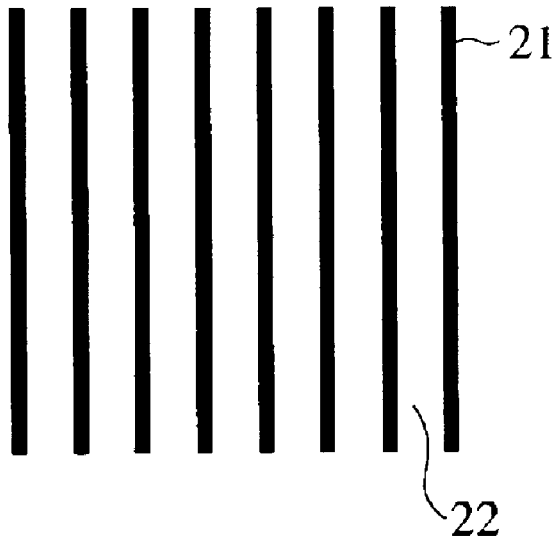
FIGS. 3A and 3B are views each showing a fluorescent film for use in an image display device according to the present invention.
Figure 3B:
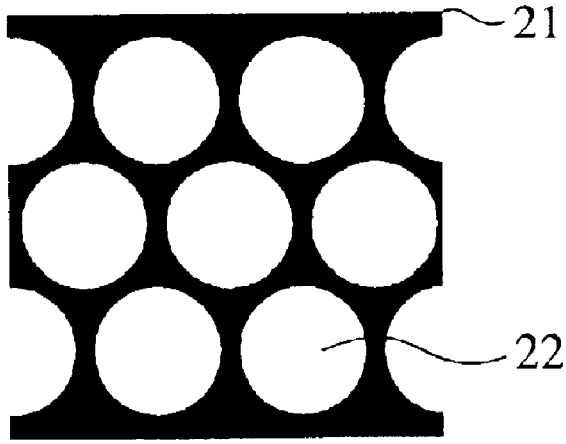

FIGS. 3A and 3B are schematic views each showing a fluorescent film used in an image display device. The fluorescent film 14 may be formed only of a fluorescent material in the case of monochrome images are created. A fluorescent film used for creating color images may be formed of a black conductive material 21, which is called black stripe or black matrix, and a fluorescent material 22. In the case of color display, the purposes of providing a black stripe or black matrix are that mixed colors or the like are made indistinctive by darkening area between the three primary fluorescent materials and that decrease in contrast caused by reflection of outside light is suppressed. As a material for the black stripe, in addition to a typical material primarily composed of graphite, a conductive material having a low degree of light transmission and light reflection can be used.

As an example of a method for manufacturing the image display device shown in FIG. 2A, the case in which the surface conductive electron emitters are used as the electron emitters forming the electron source will be described by way of example.

Figure 4:
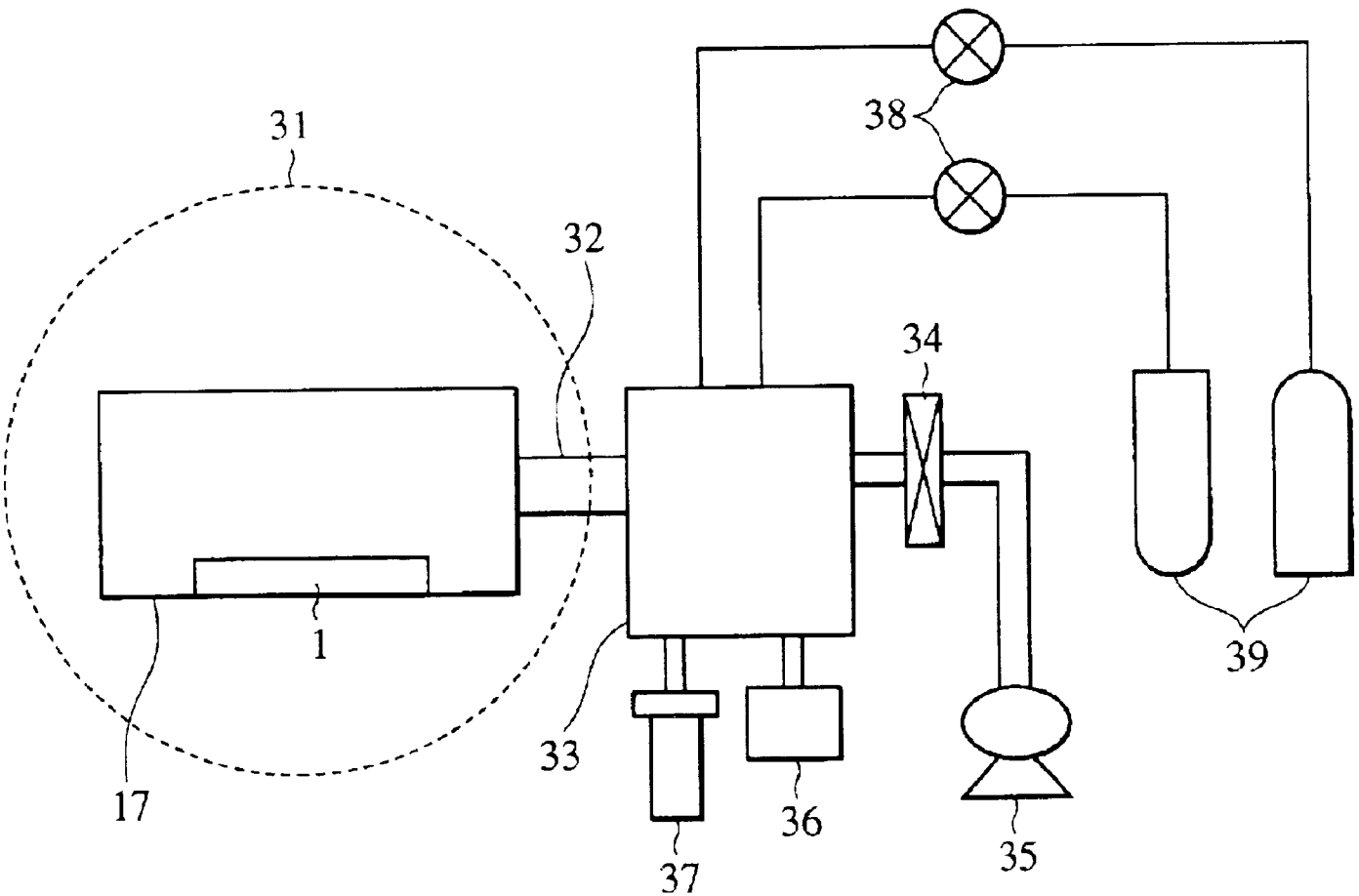
FIG. 4 is a flow diagram schematically showing a vacuum processing apparatus used for manufacturing an image display device according to the present invention.
Figure 5A:
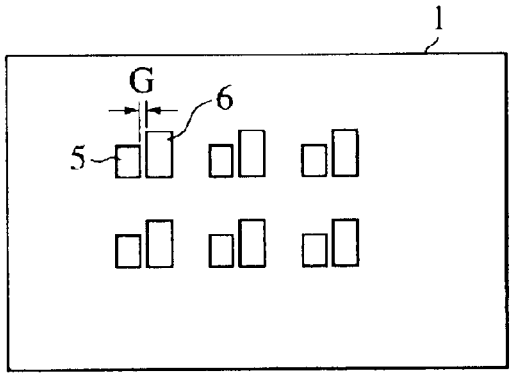
FIGS. 5A to 5F are plan views for illustrating steps of manufacturing an electron source substrate according to the present invention.
Figure 5D:
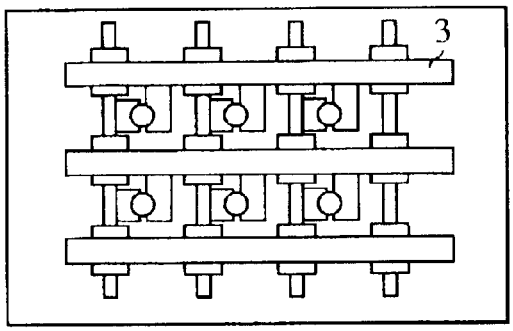
Figure 5B:
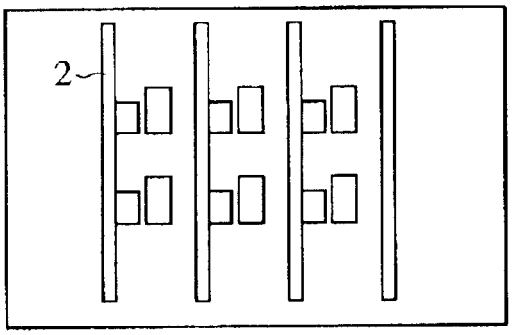
Figure 5E:
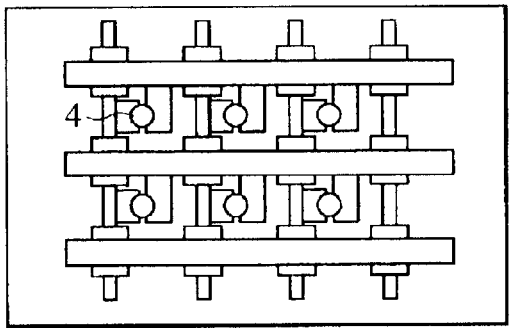
Figure 5C:
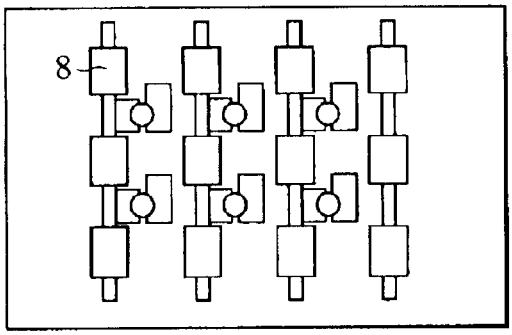
Figure 5F:
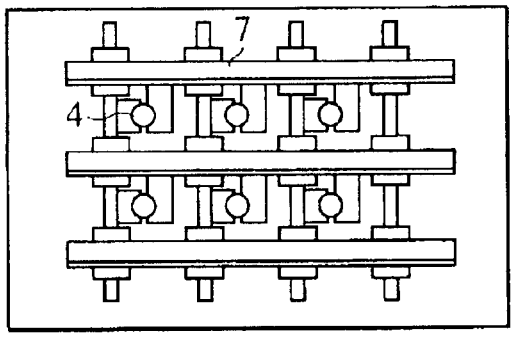

FIG. 4 is a schematic view showing an apparatus used for the manufacturing method described above. An image display device 31 is connected to a vacuum chamber 33 via an exhaust pipe 32 and is further connected to an exhaust device 35 via a gate valve 34. In order to measure a pressure inside the vacuum chamber 33 and partial pressures of individual components therein, a pressure gauge 36, a quadrupole mass spectrometer 37, and the like are provided for the vacuum chamber 33. Since it is difficult to directly measure a pressure inside the vacuum container 17 of the image display device 31, a pressure or the like inside the vacuum chamber 33 is measured for controlling operation conditions.

Since necessary gases are supplied inside the vacuum chamber 33 and the atmosphere therein is controlled, gas supply lines are connected to the vacuum chamber 33. The other end of each of the gas supply lines is connected to a supply material source 39, and a supply material is stored in an ampoule or a cylinder. Supply amount control means 38 for controlling a supply rate of the supply material is installed midway in each of the gas supply lines. As this supply amount control means 38, in particular, a valve such as a slow leak valve which can control a flow volume, a mass flow controller, or the like may be used in accordance with a type of supply material.

The inside of the container 17 is evacuated by the apparatus shown in FIG. 4, and forming treatment is performed for conductive films formed between the electrodes, thereby forming electron emission portions. When the forming treatment is performed by applying a voltage, an applied pulse form, and conditions for determining the end point of the treatment may be selected in accordance with forming performed for one conductive film. In addition, by applying (scrolling) pulses sequentially shifted in phase to a plurality of X-directional wires, forming may be preformed collectively for elements connected to the plurality of X-directional wires.

After the forming being completed, a step of activation is performed. After the inside of the container 17 is sufficiently evacuated, an organic material is supplied through the gas supply line. When a voltage is applied to the conductive film which was processed by forming in an atmosphere containing the organic material, carbon, a carbonized material, or the mixture thereof is deposited on the electron emission portions, and as a result, an amount of electron emission is significantly increased. Application of a voltage in this step may be performed by simultaneously applying a voltage pulse to conductive films connected to each wire extending in one direction as in the case of the forming described above. By performing this activation step, the electron emitters are formed. After the activation step being completed, a stabilizing step described below is preferably performed.

While being maintained at a temperature of 250 to 350° C. by heating, the container 17 is evacuated via the exhaust pipe 32 by the exhaust device 35, such as an ion pump or a sorption pump, which does not require oil, thereby obtaining an atmosphere containing sufficiently small amount of organic materials. In this step, the non-evaporable getters 7 disposed in the image display area and the ring non-evaporable getters 10 disposed outside the image display area are activated by heating, and hence the evacuation capabilities of the getters can be obtained. In addition, in order to maintain a pressure inside the container 17 after sealing, just before the exhaust pipe is completely sealed, the non-evaporable getters 10 provided outside the image display area are activated by high-frequency induction heating. Subsequently, the exhaust pipe is melted and tipped off by heating for completely sealing.

In addition to display devices for television broadcasting, and display devices for television conference system or computers, the image display device of the present invention may be applied to image display devices such as an optical printer formed of a light sensitive drum and the like.

EXAMPLES

Hereinafter, the present invention will be described in detail with reference to particular examples; however, the present invention is not limited to these examples described below and may be variously modified without departing from the spirit and the scope of the present invention.

First Example

An image display device of this example has the structure equivalent to that of the device which is schematically shown in FIGS. 2A and 2B, the first getters 7 formed of non-evaporable getter layers are provided on the X-directional wires (upper wires) formed by a printing method, and the ring second getters 10 each formed of the core wire and the non-evaporable getter material are provided along four sides of the periphery of the image display area. In addition, the image display device of this example comprises an electron source formed of a plurality (100 rows×300 columns) of surface conductive electron emitters wired to each other in a simple matrix.

Hereinafter, a method for manufacturing the image display device of this example will be described with reference to FIGS. 5A to 5F.

Step A

A substrate 1 was sufficiently washed using a detergent, purified water, and an organic solvent. A silicon oxide film 0.5 μm thick was formed on the substrate 1 by sputtering, thereby forming the electron source substrate 1. Subsequently, on the electron source substrate 1, a pattern for forming the electrodes 5 and 6 and gaps G between the electrodes was formed using a photoresist (RD-2000N-41 manufactured by Hitachi Chemical Co., Ltd.), and by a vacuum deposition method, titanium (Ti) 5 nm thick and nickel (Ni) 100 nm thick were sequentially formed in that order. The photoresist pattern was dissolved in an organic solvent so as to lift off the Ni/Ti deposition film, thereby forming the elemental electrodes 5 and 6 having a width of 300 μm and a gaps G of 3 μm. (See FIG. 5A)

Step B

Subsequently, by using a screen printing method, the lower wires 2 were each formed so as to be in contact with the electrodes 5, and by firing at 400° C., the lower wires 2 having a desired shape were formed. (See FIG. 5B)

Step C

Next, the desired interlayer insulating layers 8 were formed at the intersection between the upper and the lower wires by a step of screen printing followed by firing at 400° C. (See FIG. 5C)

Step D

The upper wires 3 were formed by a printing step using a screen printing method so as to be in contact with the electrodes 6, which were not contact with the lower wires, followed by a step of firing at 400° C. (See FIG. 5D)

Step E

A chromium (Cr) film 100 nm thick was formed by a vacuum deposition method and was then patterned, a palladium (Pd) amine complex solution (ccp4230 manufactured by Okuno Chemical Industries Co., Ltd.) was applied on the patterned chromium film described above by spin coating using a spinner, and heating treatment was performed at 300° C. for 10 minutes for firing. The conductive films 4 thus obtained for forming electron emission portions were each composed of fine particles containing Pd as a primary element and had a film thickness of 8.5 nm and a sheet resistance of $3.9\times10^4$ Ω/. The Cr film and the conductive films 4 for forming the electron emission portions after firing were etched by an acidic etchant to form a desired pattern.

By the steps described above, the conductive films 4 for forming a plurality (100 rows×300 columns) of the electron emission portions were connected to the lower wires 2 and the upper wires 3 which were disposed in a simple matrix. (See FIG. 5E)

Step F

A metal mask provided with openings in the form of the upper wire 3 was prepared, and after sufficient alignment was performed, a Zr—V—Fe alloy was sputtered to form a film. The non-evaporable getters (first getters) 7 thus formed in the image display area were processed so as to have a thickness of 2 μm (See FIG. 5F). The composition of a sputtering target used in this example was 70% of Zr, 25% of V, and 5% of Fe on a weight basis.

Step G

A wire composed of a nichrome wire 200 μm in outer diameter tightly bonded with a non-evaporable getter material made of a Zr—V—Fe—Ni alloy was formed into a ring, and the ring was then fixed by spot welding on the above-mentioned fixing member 18 containing alloy 426 shown in FIG. 1A. In addition, this fixing member 18 was fixed on the electron source substrate 1 using frit glass, thereby disposing the non-evaporable second getters 10 outside the image display area.

According the steps described above, the electron source substrate 1 was formed having the first getters disposed in the image display area and the ring non-evaporable second getters disposed outside the image display area.

Step H

Next, the face plate 16 shown in FIG. 2A was formed by steps described below. The glass substrate 13 was sufficiently washed with a detergent, purified water, and an organic solvent. Subsequently, the fluorescent film 14 was formed by a printing method on the glass substrate 13 for surface planarizing treatment (generally called "filming"), thereby forming a fluorescent portion. In this example, the fluorescent film 14 was a film shown in FIG. 3A in which fluorescent stripes (R, G, and B) 22 were aligned with black conductive stripes (black stripes) 21 provided therebetween. In addition, on the fluorescent film 14, the metal back 15 of an aluminum (Al) thin-film 0.1 μm thick was formed by sputtering.

Step I

Next, the container 17 shown in FIG. 2A was formed by steps described below.

After the electron source substrate 1 formed by the steps described above was fixed on the reinforcing plate 11, the supporting frame 12 and the face plate 16 were combined with each other, and the lower wires 2 and the upper wires 3 were connected to signal input terminals and row selection terminals, respectively. In addition, the position of the electron source substrate 1 and that of the face plate 16 were exactly aligned with each other and were then bonded together for sealing, thereby forming the container 17. The bonding for sealing was performed by applying frit glass at bonding portions followed by heat treatment which was performed at 450° C. for 30 minutes in an argon (Ar) gas atmosphere. Fixing of the electron source substrate 1 to the reinforcing plate 11 was performed in a manner similar to that described above.

Figure 6:
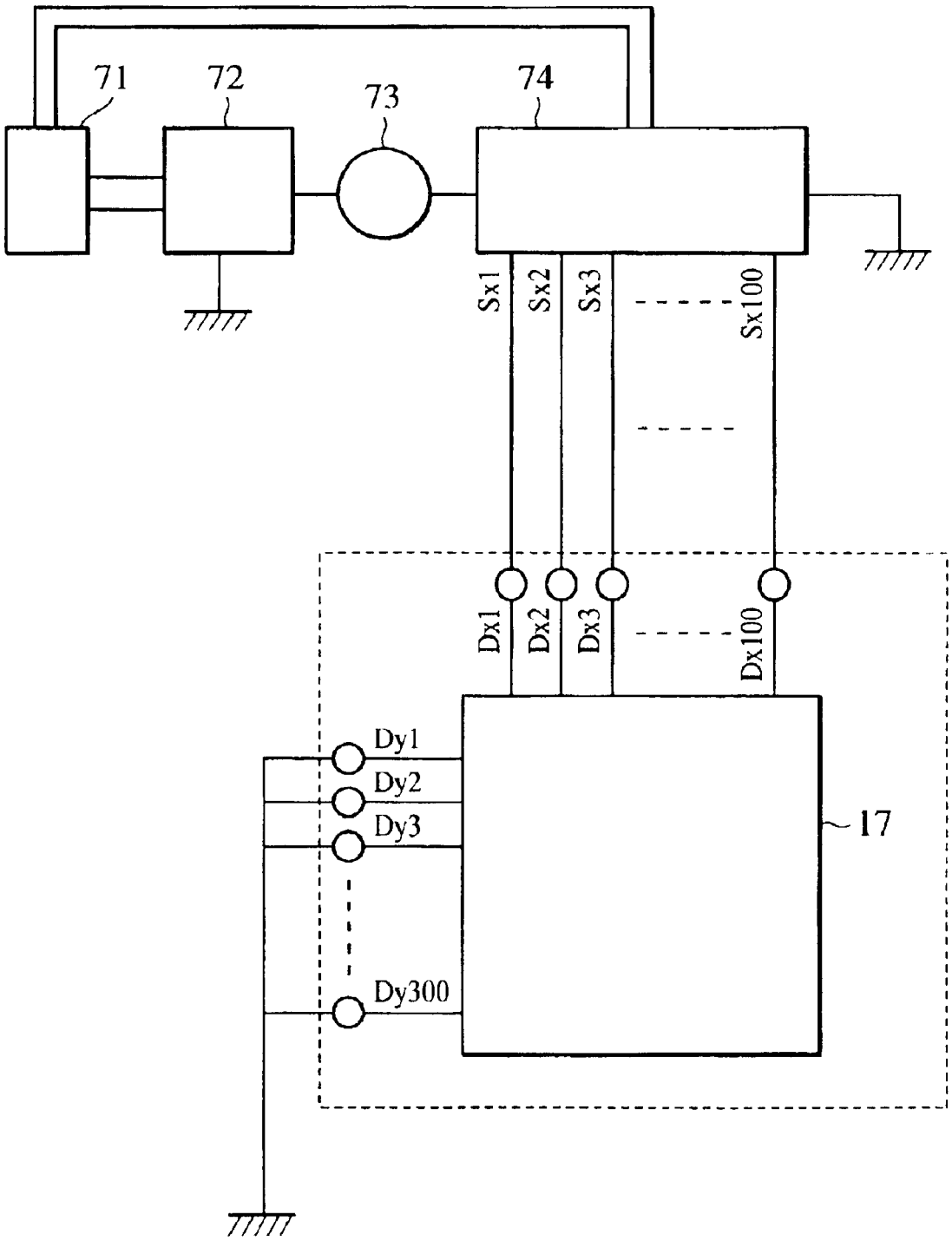
FIG. 6 is a schematic view showing an apparatus for manufacturing evaluation provided with various devices necessary for manufacturing an image display device according to the present invention.

Next, by using the vacuum processing apparatus shown in FIG. 4, which was provided with necessary devices as shown in FIG. 6, subsequent steps were performed.

Step J

The inside of the container 17 was evacuated to a pressure of $1\times10^{-3}$ Pa or less, and forming treatment for forming the electron emission portions on the conductive films 4, which were aligned on the electron source substrate 1 for forming the electron emission portions, was performed.

As shown in FIG. 6, the Y-directional wires were collectively connected to the earth. Reference numeral 71 indicates a control device for controlling a pulse generator 72 and row selection device 74. Reference numeral 73 indicates an ampere meter. By the row selection device 74, one row was selected among the X-directional wires 3, and a pulse voltage was applied to said one row thus selected. The forming treatment for conductive films disposed in rows (300 elements in each row) in the X-direction was performed on a row by row basis. The pulse used in this example was a triangle pulse, and the wave height thereof was gradually increased. Pulse width T1 and pulse interval T2 were set to 1 and 10 milliseconds, respectively. In addition, between the triangular pulses, a rectangular pulse having a wave height of 0.1 volts was inserted, and by measuring the current, resistance of each row was obtained. When the resistance exceeded 3.3 kΩ per row (1 MΩ in one conductive film), the forming for the row was finished and was then performed for a row adjacent thereto. By the forming treatment performed for every row, every conductive film 4 was processed by the forming treatment, and the electron emission portion was formed in every conductive film, thereby forming the electron source substrate 1 provided with a plurality of the surface conductive electron emitters connected to each other in a simple matrix manner.

Step K

Benzonitrile held beforehand in the material source 39 was supplied into the vacuum chamber 33, the pressure therein was controlled at $1.3\times10^{-3}$ Pa, and pulses were applied to the electron source while an emitter current If was measured, thereby performing activation treatment for individual electron emitters. The pulse generated from the pulse generator 72 has a rectangular waveform having a wave height of 14 volts, a pulse width T1 of 100 microseconds, and a pulse interval T2 of 167 microseconds. By the row selection device 74, the rows were sequentially selected from Dx1 to Dx100 with an interval of 167 microsecond, and as a result, rectangular waves, which had a T1 of 100 microseconds and a T2 of 16.7 milliseconds and which were sequentially shifted in phase among the rows, were applied to the emitters on a row by row basis.

The ampere meter 73 was used in a mode in which the averaged current was detected when the rectangular pulse was in an ON-state (in a state in which the voltage was 14 V). When the average current reached 600 mA (2 mA per element), the activation treatment was completed, and the container 17 was evacuated. By the steps described above, the conductive films 4 become capable of emitting electrons.

Step L

While the evacuation was continued, the second getters 10 disposed outside the image display area were heated to 750° C. and was then maintained for 10 minutes by a high-frequency power supply (not shown). The application conditions of the high-frequency power supply were determined in accordance with the size of a wire loop which was provided: however, in consideration of conditions studied beforehand, a temperature of approximately 750° C. was selected.

Step M

While the evacuation was further continued, the entirety of the image display device 31 and the vacuum chamber 33 was heated to 300° C. and was maintained for 10 hours by a heating device (not shown). By this step, benzonitrile and the decomposition product thereof, which might adsorb on the inside walls of the container 17 and the vacuum chamber 33, were removed. This was confirmed by observation using the mass spectrometer 37. In the step described above, by heating and evacuation for a predetermined time of the image display device, in addition to the removal of gases form the inside of the image display device, the activation treatment of the non-evaporable getters was also performed.

In the step described above, heating was performed at 300° C. for 10 hours; however, the conditions are not limited thereto. The effects of removing benzonitrile and activating the non-evaporable getters described above were naturally obtained when the heating was performed at a higher temperature, and in addition, when the heating time was increased even at a lower heating temperature, the same effects as described above were also obtained.

Step N

After it was confirmed that the pressure was decreased to $1.3\times10^{-5}$ Pa or less, the exhaust pipe was melted and tipped off by heating for sealing.

According to the steps described above, the image display device of this example, that is, the image display device having the first getters 7 which were disposed in the image display area and the ring non-evaporable second getters 10 disposed outside the image display area, was formed.

In this example, the electrodes and the conductive thin-films were all formed using a photolithographic method and a vacuum deposition method; however, in addition to the methods mentioned above, the same structure as described above can be formed using a printing method, a plating method, or a drawing method using a dispenser.

First Comparative Example

An image display device was formed in a manner equivalent to that in the example described above except that Step G was not performed, that was, an image display device was formed without the ring non-evaporable second getters provided outside the image display area.

Second Comparative Example

Instead of Step G in the example described above, a strip non-evaporable getter 2 mm wide, 100 mm long, and 0.5 mm thick was formed outside the image display area by steps described below.

A nickel wire 50 μm in diameter was connected to the two ends of the strip non-evaporable getter by spot welding, and the getter was fixed in a groove formed beforehand in the supporting frame using the nickel wire. One end of the nickel wire extended outside the vacuum container so that electricity can be supplied therethrough. Accordingly, an image display device was formed having the non-evaporable getters 7 provided in the image display area and the strip non-evaporable getter provided outside the image display area.

The following evaluations were performed for the image display devices formed in the example and the comparative examples described above.

For evaluation, light emission was continuously performed from the entire surface of the image display device by simple matrix driving, and while voltage Va applied to an anode was maintained at 3 kV, the brightness was measured with time.

The initial brightnesses of the display devices of the example, the first comparative example, and the second comparative examples were different from each other; however, when light emission was continuously performed, the brightnesses were gradually decreased on the whole. A manner of decrease in brightness varied depending on pixel positions which were measured in each display device described above.

However, when the light-emitting pixels were examined in detail, the brightnesses of the light-emitting pixels of the image display device according to the first comparative example largely varied therebetween, and the decrease in brightness after an elapse of a predetermined time was also large as compared to those of the image display devices of the example and the second comparative example.

Next, light emission was continuously performed from the entire surface of the image display device of each of the example, the first comparative example, and the second comparative example, and voltage Va applied to the anode was gradually increased up to 10 kV. With the increase in voltage Va, the brightness was increased. Manners of increase in brightness were different among the display devices according to the example, the first comparative example, and the second comparative example; however, variation in brightness of the light-emitting pixels of the image display device according to the first comparative example was apparently large, and in addition, after an elapse of a predetermined time, the brightness was extremely decreased.

In addition, five image display devices according to each of the example and the second comparative example were formed. As a result, in a process for manufacturing the image display device of the second comparative example, a vacuum leak occurred in one of the image display devices. When the leak was inspected in detail using a helium leak detector, a small leak was found at the position between the nickel wire connected to the strip non-evaporable getter and the supporting frame. In addition, one image display device among the four devices in which a vacuum leak did not occur was damaged while the strip non-evaporable getter was heated (activation step) by supplying electricity. When the damage was inspected in detail, it was considered that the damage was caused by stress since the strip non-evaporable getter was distorted by heating and was then brought into contact with glass. That is, in the process for manufacturing the image display device provided with the strip non-evaporable getters, it was understood that sufficient care must be paid to a heating temperature in a step of sealing the container and/or a step of heating the getters by supplying electricity.

In contrast, all the five image display devices according to the example could be formed without any vacuum leak and damage.

As has thus been described, according to the present invention, an image display device which can withstand high voltage applied thereto and which has a small degradation of electron emission with time can be provided.

In addition, according to the present invention, the image display device in which each pixel has stable light emission over a long period of time can be manufactured with a high yield, and hence high-performance image display apparatuses such as a color flat television can be realized.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image display device comprising:

a container comprising:

a substrate;

an electron source provided on the substrate;

an image display member which opposes the electron source substrate and which displays an image when being irradiated with electrons emitted form the electron source;

first getters disposed in an image display area which is located between the electron source and the image display member; and ring non-evaporable second getters which are provided outside the image display area.

2. An image display device according to claim 1, wherein the second getters are provided so as to surround the first getters.

3. An image display device according to claim 1, wherein the first getters are non-evaporable getters.

4. An image display device according to claim 1, wherein the electron source comprises a plurality of electron emitters and wires for said plurality of electron emitters, and the first getters are disposed on the wires.

* * * * *